US006763968B1

(12) United States Patent
Boyd et al.

(10) Patent No.: US 6,763,968 B1
(45) Date of Patent: Jul. 20, 2004

(54) BASE PORTION OF A PLASTIC CONTAINER

(75) Inventors: Timothy J. Boyd, Ypsilanti, MI (US); Dwayne G. Vailliencourt, Manchester, MI (US); Kerry W. Silvers, Chelsea, MI (US); Richard J. Steih, Britton, MI (US); G. David Lisch, Jr., Jackson, MI (US)

(73) Assignee: Schmalbach-Lubeca AG (DE)

( * ) Notice: Subject to any disclaimer, the term of this patent is extended or adjusted under 35 U.S.C. 154(b) by 0 days.

(21) Appl. No.: 09/608,738

(22) Filed: Jun. 30, 2000

(51) Int. Cl.[7] ..... B65D 6/28
(52) U.S. Cl. ..... 220/608; 220/609; 215/376
(58) Field of Search ..... 220/608, 609; 215/376

(56) References Cited

U.S. PATENT DOCUMENTS 4,375,442 A 3/1983 Ota et al.
4,379,099 A 4/1983 Ota et al.
4,572,811 A 2/1986 Ota et al.
4,590,021 A 5/1986 Ota et al.
4,755,404 A * 7/1988 Collette ..... 428/36.92
5,067,622 A * 11/1991 Garver et al. ..... 215/381
5,261,545 A 11/1993 Ota et al.
5,419,866 A * 5/1995 Valyi ..... 264/521
5,520,877 A * 5/1996 Collette et al. ..... 264/521
5,735,420 A * 4/1998 Nakamaki et al. ..... 215/373
5,759,656 A * 6/1998 Collette et al. ..... 428/36.91
5,762,982 A * 6/1998 Knepper et al. ..... 425/526
5,829,614 A * 11/1998 Collette et al. ..... 215/375
5,853,829 A * 12/1998 Krishnakumar et al. ... 428/35.7
5,906,286 A * 5/1999 Matsuno et al. ..... 215/375

* cited by examiner

*Primary Examiner*—Mickey Yu
*Assistant Examiner*—Troy G Arnold, III
(74) *Attorney, Agent, or Firm*—Harness, Dickey & Pierce, P.L.C.

(57) ABSTRACT

A plastic container for receiving a commodity and retaining the commodity during high-temperature pasteurization and subsequent cooling that includes an upper portion, a sidewall portion, and a base portion. The upper portion defines an aperture and is sealable with a closure. The sidewall portion, which defines a sidewall diameter, is connected to and extends generally downward from the upper portion. The base portion has a chime section connected to and extending generally downward and inward from the sidewall portion, and a push-up section connected to and extending generally upward and inward from the chime section to close the plastic container. The push-up section defines a push-up diameter, and the ratio of the sidewall diameter to the push-up diameter is at least 1.3:1.0.

15 Claims, 1 Drawing Sheet

BASE PORTION OF A PLASTIC CONTAINER

TECHNICAL FIELD OF THE INVENTION

This invention generally relates to plastic containers. More specifically, this invention relates to base portions of plastic containers for receiving a commodity and retaining the commodity during high-temperature pasteurization and during subsequent cooling, shipment, and use of the plastic containers.

BACKGROUND

Recently, manufacturers of polyethylene terephthalate (PET) containers have begun to supply plastic containers for commodities that were previously packaged in glass containers. The manufacturers, as well as consumers, have recognized that PET containers are lightweight, inexpensive, recyclable, and manufacturable in large quantities. Manufacturers currently supply PET containers for various liquid commodities, such as juices. They also desire to supply PET containers for solid commodities, such as pickles. Many solid commodities, however, require pasteurization or retort, which presents an enormous challenge for manufactures of PET containers.

Pasteurization and retort are both methods for sterilizing the contents of a container after it has been filled. Both processes include the heating of the contents of the container to a specified temperature, usually above 70° C., for a duration of a specified length. Retort differs from pasteurization in that it also applies overpressure to the container. This overpressure is necessary because a hot water bath is often used and the overpressure keeps the water in liquid form above its boiling point temperature. These processes present technical challenges for manufactures of PET containers, since new pasteurizable and retortable PET containers for these commodities will have to perform above and beyond the current capabilities of conventional heat set containers. Quite simply, the PET containers of the current techniques in the art cannot be produced in an economical manner such that they maintain their material integrity during the thermal processing of pasteurization and retort.

PET is a crystallizable polymer, meaning that it is available in an amorphous form or a semi-crystalline form. The ability of a PET container to maintain its material integrity is related to the percentage of the PET container in crystalline form, also known as the "crystallinity" of the PET container. Crystallinity is characterized as a volume fraction by the equation:

$$\%\ \text{Crystallinity} = \frac{\rho - \rho_\alpha}{\rho_c - \rho_\alpha} \times 100$$

where $\rho$ is the density of the PET material; $\rho_a$ is the density of pure amorphous PET material (1.333 g/cc); and $\rho_c$ is the density of pure crystalline material (1.455 g/cc). The crystallinity of a PET container can be increased by mechanical processing and by thermal processing.

Mechanical processing involves orienting the amorphous material to achieve strain hardening. This processing commonly involves stretching a PET container along a longitudinal axis and expanding the PET container along a transverse axis. The combination promotes biaxial orientation. Manufacturers of PET bottles currently use mechanical processing to produce PET bottles having roughly 20% crystallinity (average sidewall crystallinity).

Thermal processing involves heating the material (either amorphous or semi-crystalline) to promote crystal growth. Used by itself on amorphous material, thermal processing of PET material results in a spherulitic morphology that interferes with the transmission of light. In other words, the resulting crystalline material is opaque (and generally undesirable as the sidewall of the container). Used after mechanical processing, however, thermal processing results in higher crystallinity and excellent clarity. The thermal processing of an oriented PET container, which is known as heat setting, typically includes blow molding a PET preform against a heated blow mold, at a temperature of 120–130° C., and holding the blown container for about 3 seconds. Manufacturers of PET juice bottles, which must be hot filled at about 85° C., currently use heat setting to produce PET juice bottles having a range of up to 25–30% crystallinity. Although these hot fill PET containers exhibit a significant improvement over the non-hot fill PET containers, they cannot maintain their material integrity during the thermal processing of pasteurization and retort, especially in their base portion, which, until now, have exhibited a roll-out failure.

Thus, the manufacturers of PET containers desire a container design that maintains its material integrity during subsequent pasteurization or retort of the contents within the PET container, and during subsequent cooling, shipment, and use of the PET containers. It is therefore an object of this invention to provide such a PET container that overcomes the problems and disadvantages of the conventional techniques in the art.

SUMMARY OF THE INVENTION

Accordingly, this invention provides for a plastic container having a particular base portion that allows the PET container to maintain its material integrity during subsequent mild pressures (35 to 175 kPa) encountered during high-temperature pasteurization or retort of the contents within the PET container, and during subsequent cooling, shipment, and use of the PET container. As used herein, "high-temperature" pasteurization and retort are pasteurization and retort processes in which the plastic container is exposed to temperatures greater than about 80° C.

At its broadest, the invention is a plastic container for receiving a commodity and retaining the commodity during high-temperature pasteurization and subsequent cooling that includes an upper portion, a sidewall portion, and a base portion. The upper portion defines an aperture and is sealable with a closure. The sidewall portion, which defines a sidewall diameter, is connected to and extends generally downward from the upper portion. The base portion has a chime section connected to and extending generally downward and inward from the sidewall portion, and a push-up section connected to and extending generally upward and inward from the chime section to close the plastic container. The push-up section defines a push-up diameter, and the ratio of the sidewall diameter to the push-up diameter is at least 1.3:1.0.

Further features and advantages of the invention will become apparent from the following discussion and accompanying drawings.

DETAILED DESCRIPTION OF THE PREFERRED EMBODIMENT

The following description of the preferred embodiment is merely exemplary in nature, and is in no way intended to limit the invention or its application or uses.

Figure 1:
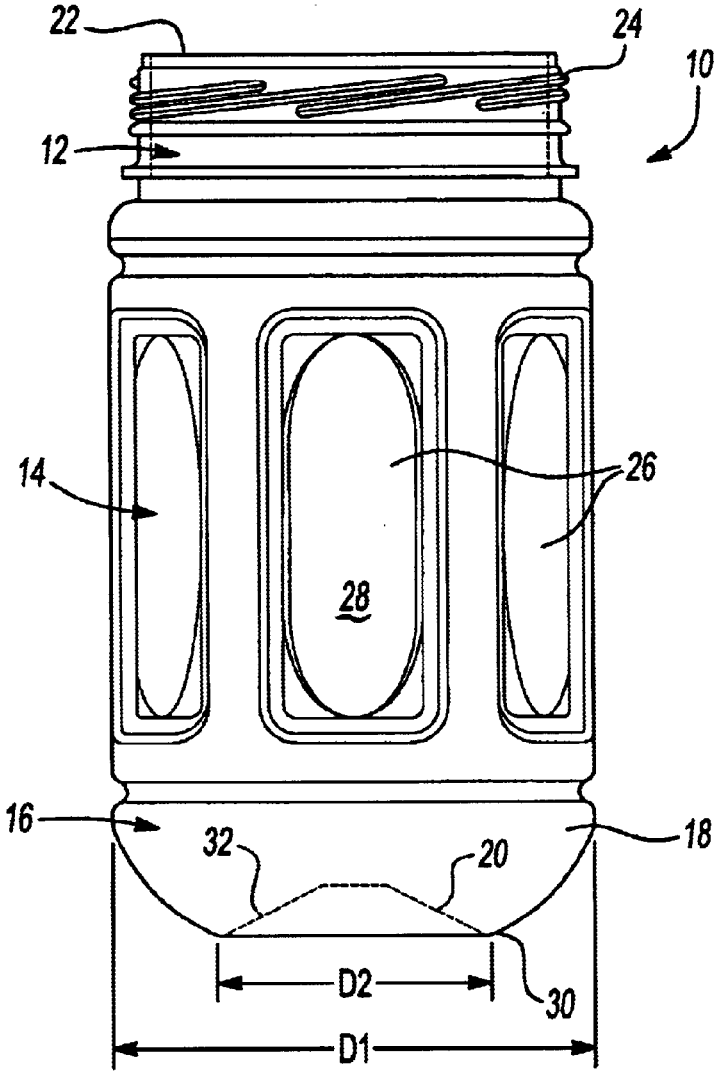
FIG. 1 is a side view of the plastic container of the preferred embodiment of the invention.

As shown in FIG. 1, a plastic container 10 of the preferred embodiment of the invention includes an upper portion 12, a sidewall portion 14, and a base portion 16 having a chime section 18 and a push-up section 20. Although the plastic container 10 has been specifically designed for receiving a commodity and retaining the commodity during high-temperature pasteurization or retort, the plastic container 10 may be used for receiving a commodity and retaining the commodity during other thermal processes, such as a hot-fill process. Further, although the plastic container 10 has been specifically designed to be made with a PET material, the plastic container 10 may be made with other suitable plastic materials.

The upper portion 12 of the preferred embodiment of the invention defines an aperture 22. The aperture 22 preferably has a 63–82 mm diameter, which qualifies as a "wide mouth" container, but may alternatively have other suitable diameters. The upper portion 12 of the preferred embodiment of the invention is sealable with a closure (not shown). In the preferred embodiment, the upper portion 12 includes a threaded finish 24 that engages with a threaded closure (not shown). In an alternative embodiment, the upper portion 12 may include a ridge or flange that engages with a snap closure.

Figure 2:
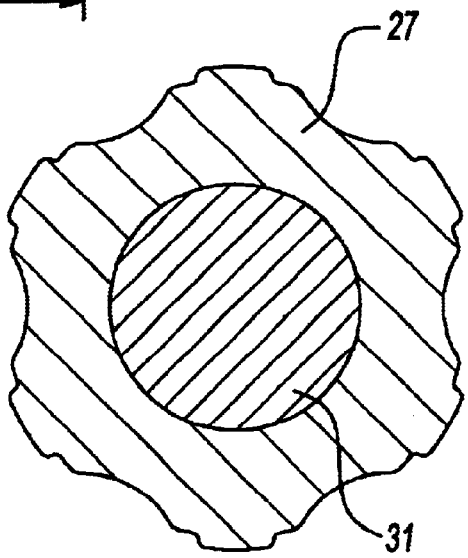
FIG. 2 is a view of the projected areas of the sidewall and the push-up of the preferred embodiment of the invention.

The sidewall portion 14 of the preferred embodiment of the invention is connected to and extends generally downward from the upper portion 12. The sidewall portion 14 preferably includes several panels 26, but may alternatively include smooth or ribbed surfaces, a grip surface, a label surface, or any combination of these or other suitable surfaces. The sidewall portion 14 of the preferred embodiment of the invention defines a sidewall diameter D1. In the preferred embodiment, the sidewall diameter D1 is substantially constant from the upper region of the sidewall portion 14 to the lower region of the sidewall portion 14. In alternative embodiments, where the sidewall diameter D1 is not substantially constant, the sidewall portion 14 defines a sidewall projected area 27, taken along a horizontal plane at the middle of the sidewall portion 14 (as shown in FIG. 2). Such a sidewall projected area 27 is commonly understood by those skilled in the art as the area of an imaginary plane having a boundary equivalent to the silhouette of the plastic container 10.

The base portion 16 and chime section 18 of the preferred embodiment of the invention is connected to and extends generally downward and inward from the sidewall portion 14. The chime section 18 preferably has a concave shape relative to and when viewed from an interior portion 28 of the plastic container 10, but may alternatively have a truncated-cone shape, a convex shape, or any other suitable shape. The push-up section 20 of the preferred embodiment of the invention is connected to and extends generally upward and inward from the lowermost portion of the chime section 18 to close the plastic container 10. The push-up section 20 preferably has a truncated-cone shape, but may alternatively have a concave shape, a convex shape, or any other suitable shape. In the preferred embodiment, the region where the chime section 18 joins to the push-up section 20 defines a sharp transition 30. As used herein, a transition is considered sharp when the transition forms a hard corner as opposed to a soft or rounded corner. In other words, the transition is not blended or smoothed by an intentionally formed radius in the transition. Generally in container formation, sharp corners or transitions are avoided. In alternative embodiments, the chime section 18 and the push-up section 20 may define a rounded transition with a significant radius. The outboardmost portion of the push-up section 20, at the sharp transition 30 between the chime section 18 and the push-up section 20, defines a push-up diameter D2. In the preferred embodiment of the invention, the sharp transition 30 between the chime section 18 and the push-up section 20 defines a substantially constant push-up diameter D2 about a central axis of the plastic container 10. Further, in the preferred embodiment of the invention, the sharp transition 30 between the chime section 18 and the push-up section 20 is substantially constant along the axis of the plastic container 10. In other words, the entire surface of the sharp transition 30 between the chime section 18 and the push-up section 20 defines a contact ring which would rest upon a table surface if the plastic container 10 was placed in an upright position on the table surface. Said differently, a support surface of the base Portion 16 is defined substantially entirely by the sharp transition 30 between the push-up section 20 and the chime section 18. In an alternative embodiment, the sharp transition 30 between the chime section 18 and the push-up section 20 may vary about the axis and along the axis. In this situation, the outboardmost portion of the push-up section 20, at the sharp transition 30 between the chime section 18 and the push-up section 20, would define a push-up projected area 31 (as shown in FIG. 2).

The ratio of the sidewall diameter D1 to the push-up diameter D2 of the preferred embodiment of the invention is at least 1.3:1.0. More preferably, the ratio of the sidewall diameter D1 to the push-up diameter D2 is 1.5:1.0. Said differently, the sidewall diameter D1 is preferably between 40% and 60% greater than the push-up diameter D2, but the ratio and percentage may alternatively be less than or greater than this preferred ratio and percentage. In a typical container, the sidewall diameter is approximately 10% to 20% greater than the resting surface diameter. Here, the sidewall diameter D1 is preferably approximately 52% greater than the push-up diameter D2. Accordingly, the push-up diameter D2 is about 62% to 71% of the sidewall diameter D1. Further, for those embodiments of the invention with a non-circular sidewall, the sidewall projected area 27 is 70% greater than the push-up projected area 31. More preferably, the sidewall projected area 27 is 125% greater than the push-up projected area 31. Said differently, the sidewall projected area is between 70% and 125% greater than the push-up projected area, but the difference may alternatively be less than or greater than this preferred difference.

After initial blow molding of the container 10, by utilizing the above base geometry, the push-up 20 is substantially comprised of material which has not been oriented as a result of the stretching and blowing of a preform into the container 10. In this non-oriented area of the base portion 16, spherulitic crystallization is imparted. Such non-oriented spherulitic crystallization typically is exhibited in a somewhat generally whitish color. Since pasteurization and retort processes will subject the container to temperatures above the material's glass transition temperature, the high crystallinity levels in the push-up 20 operate to ensure the stability of the base portion 16. It is further noted that the non-oriented material may be confined entirely to the push-up 20, may terminate at the transition 30, or may even extend to the chime portion 18. In the latter situation, the spherulitically crystallized non-oriented material is generally confined to the lowermost regions of the chime portion 18, adjacent to the transition 30, as seen in FIG. 1.

The push-up 20 of the base portion 16 of the preferred embodiment of the invention has an average crystallinity of at least 20%. This feature of the push-up 20, together with the ratio of the sidewall diameter D1 to the push-up diameter D2 and the sharp transition 30, allows the plastic container 10 to maintain its material and structural integrity during subsequent high-temperature pasteurization or retort of the commodity within the plastic container 10, during the resultant pressure increases, and during subsequent cooling, shipment, and use of the plastic container 10 without any distortion of the geometry of the base during the process of the base portion 16. A portion of the push-up 20 of the base portion 16 may have an average density of 1.370 g/cc (roughly corresponding to 30% crystallinity) 1.375 g/cc (roughly corresponding to 34.4% crystallinity) and even 1.380 g/cc (roughly corresponding to 38.5% crystallinity). The push-up 20 of the base portion 16 may alternatively have a crystallinity of at least 30% along a portion of the interior surface 32, which may be significantly greater than the average crystallinity of the push-up 20. The interior surface 32, as defined by the first 10% of the push-up 20, may have a crystallinity of 35%, 40%, or even 45%.

The average density and the average crystallinity of the push-up 20 of base portion 16 of the plastic container 10 is preferably achieved with the blow molding machine and method described in U.S. Pat. No. 6,514,451, issued on Feb. 4, 2003, which is hereby incorporated in its entirety by this reference, but may alternatively be achieved with other suitable machines and methods. The blow molding machine and method preferably induces the crystallinity of the push-up 20 of the base portion 16 by applying heat from a mold and by applying heat from the interior portion 28 of the plastic container 10. More specifically, the method uses convection heat transfer by circulating a high-temperature fluid through the interior portion 28 of the plastic container 10. By using this blow molding machine and method, together with the ratio of the sidewall diameter D1 to the push-up diameter D2, a plastic container 10 that maintains its material integrity during subsequent high-temperature pasteurization and retort, and during subsequent cooling, shipment, and use, may be efficiently and effectively provided.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

We claim:

1. A heat sterilizable PET container for receiving a commodity, said heat sterilizable PET container comprising:

an upper portion defining an aperture and sealable with a closure;

a sidewall portion connected to and extending generally downward from said upper portion, said sidewall portion defining a sidewall diameter; and a base portion having a chime section connected to and extending generally downward and inward from said sidewall portion, and a push-up section having a substantially truncated conical shape and with a relatively sharp transition connected to and extending generally upward and inward from said chime section to close said heat sterilizable PET container, said push-up section having an outboardmost portion and a push-up diameter measured at said outboardmost portion, said sidewall diameter being between 40% and 60% greater than said push-up diameter, said base portion exhibiting a non-oriented spherulitic crystallization portion approximately equal in size to said push-up diameter and with a crystallinity of at least 25%, a support surface of said base portion being defined substantially entirely by said share transition between said push-up section and said chime section.

2. The heat sterilizable PET container of claim 1 wherein said non-oriented spherulitic crystallization portion of said base portion has a crystallinity of at least 30%.

3. The heat sterilizable PET container of claim 1 wherein said non-oriented spherulitic crystallization portion of said base portion has a crystallinity of at least 35%.

4. The heat sterilizable PET container of claim 1 wherein a portion of said push-up section exhibits non-oriented spherulitic crystallization.

5. The heat sterilizable PET container of claim 1 wherein a portion of said chime section exhibits non-oriented spherulitic crystallization.

6. The heat sterilizable PET container of claim 1 wherein a portion of said push-up section and a portion of said chime section exhibits non-oriented spherulitic crystallization.

7. The heat sterilizable PET container of claim 1 wherein said sidewall diameter is 50% greater than said push-up diameter.

8. A heat-resistant PET container for receiving a commodity requiring one of pasteurization and retort sterilization, said heat-resistant PET container comprising:

an upper portion defining an aperture and sealable with a closure;

a sidewall portion connected to and extending generally downward from said upper portion, said sidewall portion defining a sidewall projected area; and a base portion having a chime section connected to and extending generally downward and inward from said sidewall portion, and a push-up section having a substantially truncated conical shape and with a relatively sharp transition connected to and extending generally upward and inward from said chime section to close said heat-resistant PET container, said push-up section having an outboardmost portion defining a push-up projected area, said sidewall projected area being between 70% and 125% greater than said push-up projected area, and said base portion exhibiting a non-oriented spherulitic crystallization portion approximately equal in size to said push-up projected area and with a crystallinity of at least 30%, a support surface of said base portion being defined substantially entirely by said sharp transition between said push-up section and said chime section.

9. The heat-resistant PET container of claim 8 wherein said non-oriented spherulitic crystallization portion of said base portion has a crystallinity of at least 35%.

10. The heat-resistant PET container of claim 8 wherein said non-oriented spherulitic crystallization portion of said base portion has a crystallinity of at least 40%.

11. The heat-resistant PET container of claim 8 wherein a portion of said push-up section exhibits non-oriented spherulitic crystallization.

12. The heat-resistant PET container of claim 8 wherein a portion of said chime section exhibits non-oriented spherulitic crystallization.

13. The heat-resistant PET container of claim 8 wherein a portion of said push-up section and a portion of said chime section exhibits non-oriented spherulitic crystallization.

14. The heat sterilizable PET container of claim 1 wherein said non-oriented spherulitic crystallization portion of said base portion has a crystallinity of less than 35%.

15. The heat-resistant PET container of claim 8 wherein said non-oriented spherulitic crystallization portion of said base portion has a crystallinity of less than 35%.

* * * * *

UNITED STATES PATENT AND TRADEMARK OFFICE

CERTIFICATE OF CORRECTION

PATENT NO. : 6,763,968 B1
DATED : July 20, 2004
INVENTOR(S) : Timothy J. Boyd et al.

It is certified that error appears in the above-identified patent and that said Letters Patent is hereby corrected as shown below:

Column 4,
Line 21, "Portion" should be -- portion --.

Column 6,
Line 10, "share" should be -- sharp --.

Signed and Sealed this

Second Day of May, 2006

JON W. DUDAS
*Director of the United States Patent and Trademark Office*